US008739450B2

(12) United States Patent
Piontek

(10) Patent No.: US 8,739,450 B2
(45) Date of Patent: Jun. 3, 2014

(54) BARREL EXTENSION

(71) Applicant: E.R. Shaw, Inc., Bridgeville, PA (US)

(72) Inventor: Roy Piontek, Carnegie, PA (US)

(73) Assignee: E.R. Shaw, Inc., Bridgeville, PA (US)

( * ) Notice: Subject to any disclaimer, the term of this patent is extended or adjusted under 35 U.S.C. 154(b) by 0 days.

(21) Appl. No.: 13/739,404

(22) Filed: Jan. 11, 2013

(65) Prior Publication Data

US 2014/0075818 A1 Mar. 20, 2014

Related U.S. Application Data

(60) Provisional application No. 61/585,392, filed on Jan. 11, 2012.

(51) Int. Cl.
*F41A 21/10* (2006.01)

(52) U.S. Cl.
CPC ..... *F41A 21/10* (2013.01)
USPC ..... 42/77

(58) Field of Classification Search
CPC ..... F41A 21/10
USPC ..... 42/77, 75.02, 76.01, 75.01; 89/128, 89/14.05, 29
See application file for complete search history.

(56) References Cited

U.S. PATENT DOCUMENTS 329,793 A * 11/1885 Wheeler ..... 42/77
1,445,583 A * 2/1923 Green ..... 89/14.5
2,736,118 A * 2/1956 Clarkson et al. ..... 42/75.02
3,805,434 A * 4/1974 Sudano ..... 42/77
4,098,016 A * 7/1978 Foote ..... 42/16
4,955,157 A * 9/1990 Brighton et al. ..... 42/77
H0000926 H * 6/1991 Mahtook ..... 89/128
5,937,563 A * 8/1999 Schuetz et al. ..... 42/106
6,357,331 B1 * 3/2002 Dionne ..... 89/29
6,625,916 B1 * 9/2003 Dionne ..... 42/16
7,076,904 B1 * 7/2006 Rustick ..... 42/75.02
7,444,775 B1 * 11/2008 Schuetz ..... 42/76.01
8,087,194 B1 * 1/2012 Vuksanovich ..... 42/75.02
8,505,227 B2 * 8/2013 Barrett et al. ..... 42/75.02
2010/0170130 A1 * 7/2010 Tertin ..... 42/69.02
2011/0005383 A1 * 1/2011 Kramer ..... 89/191.01
2011/0265638 A1 * 11/2011 Overstreet et al. ..... 89/128
2012/0131834 A1 * 5/2012 Barrett et al. ..... 42/75.02

OTHER PUBLICATIONS

CMMG, Inc., (published prior to Dec. 2011). CMMG .22 Conversion for AR15 Firearms. Missouri.

* cited by examiner

*Primary Examiner* — Michael Carone
*Assistant Examiner* — Reginald Tillman, Jr.
(74) *Attorney, Agent, or Firm* — The Webb Law Firm

(57) ABSTRACT

The present invention relates to barrel extensions for firearms that have been converted to fire different, most likely lower, caliber ammunition than the firearms were originally designed to accommodate. The present invention in several embodiments is a barrel extension designed to supplement or replace the barrels and/or barrel extensions of firearms that have a sub-caliber conversion installed. Several embodiments of the present invention are configured to be installed on AR15 family rifles with a .22LR ammunition conversion to allow for accurate shooting of the .22LR ammunition through the barrel extension.

17 Claims, 7 Drawing Sheets

BARREL EXTENSION

CROSS-REFERENCE TO RELATED APPLICATION

This application is based on Provisional Patent Application No. 61/585,392, filed Jan. 11, 2012, entitled "Barrel Extension" and on which priority of this patent application is based, and which is hereby incorporated by reference in its entirety.

BACKGROUND OF THE INVENTION

1. Field of the Invention

The present invention is related to firearm caliber conversions. More specifically, the present invention relates to a barrel extension that mates a barrel to a rifle to safely achieve more accurate firing of smaller caliber ammunition than the firearm's initial configuration.

2. Description of Related Art

In order to fire a different caliber in a firearm than what the firearm was initially designed to accommodate, a caliber conversion kit or device needs to be installed in the desired firearm. Caliber conversion kits and devices which change the caliber of ammunition a firearm fires have been known in the art. The primary purpose of many of these conversion kits is to enable the firing of less expensive ammunition. Typically lower caliber ammunition is less expensive than higher caliber ammunition, although cartridge size and other factors can affect the price of the ammunition.

For example, the CMMG™.22LR conversion Model Alpha (as shown in FIG. 8) available from CMMG Inc. P.O. Box 369 Fayette, Mo. 65248 is a .22LR caliber rim-fire blowback device which replaces the standard bolt/bolt carrier assembly in the AR15 family of firearms. It should be noted that the standard bolt/bolt carrier assembly in the AR15 family are gas operated systems. The CMMG™ .22LR conversion allows for the use of .22LR ammunition in place of 5.56 NATO or .223 Rem ammunition. This particular conversion is a blow-back operated sub-caliber conversion that allows for the firing of .22LR ammunition in an AR15 or M16 firearm. The CMMG™ .22 LR conversion also includes a magazine adapted for holding .22LR ammunition and having the same or similar exterior dimensions as a standard AR15 magazine adapted to hold 5.56 NATO or .223 Rem ammunition.

One shortcoming of this type of conversion is that it still utilizes a standard AR15 barrel extension and barrel with standard diameter bore and rifling twist rate resulting in an improper fit of the .22LR bullet to the barrel. This arrangement results in bullet wobble and inaccuracy of the firearm.

There is a need for a device and/or kit to safely improve the accuracy of a rifle that is firing sub-caliber ammunition.

SUMMARY OF THE INVENTION

The present invention relates to barrel extensions for firearms that have been converted to fire different, most likely lower, caliber ammunition than the firearms were originally designed to accommodate. The present invention in several embodiments is a barrel extension and a barrel designed to supplement or replace the barrels and/or barrel extensions of firearms that have a sub-caliber conversion installed. The present invention in several embodiments is a kit of parts for supplementing or replacing the barrels and/or barrel extensions of firearms that have a sub-caliber conversion installed. The present invention in several embodiments is a method for supplementing or replacing the barrels and/or barrel extensions of firearms that have a sub-caliber conversion installed.

Several embodiments of the present invention are configured to be installed on AR15 family rifles with a .22LR ammunition conversion to allow for accurate shooting of the .22LR ammunition through the barrel extension and the barrel. The barrel may be optimized for firing .22LR ammunition.

The present invention makes use of the fact that sub-caliber conversion kits only change the bolt carrier assembly, the magazine for carrying the sub-caliber ammunition and sometimes ammo feed devices to aid in feeding the sub-caliber ammunition. In AR15 rifles, this arrangement results in an inexpensive and easy to install option, but the performance of the rifle and of the .22LR ammunition is not optimal. This is mostly due to the .22LR bullet being too small for the AR15 barrel which is designed to accommodate 5.56 NATO or .223 Rem bullets. Additionally, the twist rate of the rifling in the AR15 barrel is not optimized for firing .22LR ammunition. This size difference and twist rate causes the .22LR bullet to wobble within the barrel and therefore wobble once it exits the barrel detrimentally affecting accuracy.

The present invention in several embodiments will prevent the use of the standard AR15 bolt/bolt carrier assembly while the barrel extension is installed. This is accomplished by shaping and sizing the barrel extension so that the standard AR15 bolt/bolt carrier assembly cannot lock into the barrel extension as originally configured and therefore prevent the firing pin from deploying and striking ammunition in the rifle. For example, the barrel extension of the present invention could be constructed identically to the standard barrel extension except without the grooves shaped to accept the lugs/locking lugs of the standard bolt. However, other shaping and configurations could be used to prevent the standard bolt from locking with the barrel extension of the current invention. This safety feature aids in preventing a user from firing a larger caliber bullet through a smaller caliber barrel. For example, a user firing a .223 Rem ammunition through a barrel configured to fire .22LR ammunition could result in damage to the firearm and injury to or even death of the user.

In one embodiment, the present invention is a barrel extension device for use with a firearm for use in changing a caliber of ammunition of a firearm from a first caliber ammunition to a second caliber ammunition including, a barrel extension including, a body having a first end and a second end, and a cylindrical sidewall extending between the first end and the second end, said cylindrical sidewall defining a cavity, wherein at least a portion of the cylindrical sidewall is threaded internally and configured for attachment to a barrel, wherein the first end of the body is configured to cooperate with a caliber conversion device to enable firing of a firearm when said caliber conversion device is installed in said firearm so that the firearm can shoot a second caliber ammunition, and wherein the first end of the body is shaped not to cooperate with a bolt in a bolt carrier assembly for a first caliber ammunition to the barrel extension preventing firing of said firearm when said bolt carrier is installed in said firearm. In another embodiment, the first end of the body comprises no indentations required for receiving the bolt of said bolt carrier assembly. In still another embodiment, the cavity of the barrel extension is configured to receive an exterior profile of a caliber conversion device. In yet another embodiment, the barrel extension comprises flat portions on an exterior surface of the body of the barrel extension. In still yet another embodiment, the barrel extension and the barrel are secured to each other. In but another embodiment, a barrel configured to shoot .22LR ammunition is secured to the barrel extension.

In another embodiment, the invention is a kit of parts for installing a barrel extension device in a firearm for use in changing a caliber of ammunition of the firearm from a first caliber ammunition to a second caliber ammunition, the kit including a barrel extension, and a barrel, wherein the barrel extension includes a body with a first end and a second end, and a cylindrical sidewall extending between the first end and the second end, said cylindrical sidewall defining a cavity, wherein at least a portion of the cylindrical sidewall is threaded internally and configured for attachment to a barrel, and wherein the first end of the body is configured to cooperate with a caliber conversion device to enable firing of a firearm when said caliber conversion device is installed in said firearm so that the firearm can shoot a second caliber ammunition, and wherein the first end of the body is shaped not to cooperate with a bolt in a bolt carrier assembly for a first caliber ammunition to the barrel extension preventing firing of said firearm when said bolt carrier is installed in said firearm. In yet another embodiment, the first end of the body comprises no indentations required for receiving the bolt of said bolt carrier assembly. In still another embodiment, the cavity is configured to receive an exterior profile of a caliber conversion device. In but another embodiment, the barrel extension comprises flat portions on an exterior surface of the body of the barrel extension. In still yet another embodiment, the barrel extension and the barrel are secured to each other. In yet another embodiment, the barrel is configured to shoot .22LR ammunition, and is secured to the barrel extension.

In yet another embodiment, the invention is a method of installing a barrel extension device in a firearm for use in changing a caliber of ammunition of a firearm from a first caliber ammunition to a second caliber ammunition, the method including the steps of providing a kit of parts for installing a barrel extension in a firearm, the kit including a barrel extension, and a barrel, wherein the barrel extension comprises: a body with a first end and a second end, and a cylindrical sidewall extending between the first end and the second end, said cylindrical sidewall defining a cavity, wherein at least a portion of the cylindrical sidewall is threaded internally and configured for attachment to a barrel, wherein the first end of the body is configured to cooperate with a caliber conversion device to enable firing of a firearm when said caliber conversion device is installed in said firearm so that the firearm can shoot a second caliber ammunition, and wherein the first end of the body is shaped not to cooperate with a bolt in a bolt carrier assembly for a first caliber ammunition to the barrel extension preventing firing of said firearm when said bolt carrier is installed in said firearm, attaching the barrel extension to the barrel, and attaching the barrel extension to the upper receiver of a firearm. In another embodiment, the first end of the body comprises no indentations required for receiving the bolt of said bolt carrier assembly. In still another embodiment, the cavity is configured to receive an exterior profile of a caliber conversion device. In still yet another embodiment, the barrel extension comprises flat portions on an exterior surface of the body of the barrel extension. In but another embodiment the barrel is configured to shoot .22LR ammunition.

While the description of the present invention is primarily directed to caliber conversions related to the AR15 rifle family, the specific designs discussed could be adapted to other rifles and/or firearms.

It is an object of this invention to provide a barrel extension and a barrel that properly fits sub-caliber ammunition to improve the performance and accuracy of a firearm.

It is another object of the invention to provide a barrel extension that prevents the use of the standard AR15 bolt/bolt carrier assembly while the barrel extension is installed.

DETAILED DESCRIPTION OF THE INVENTION

Figure 1:
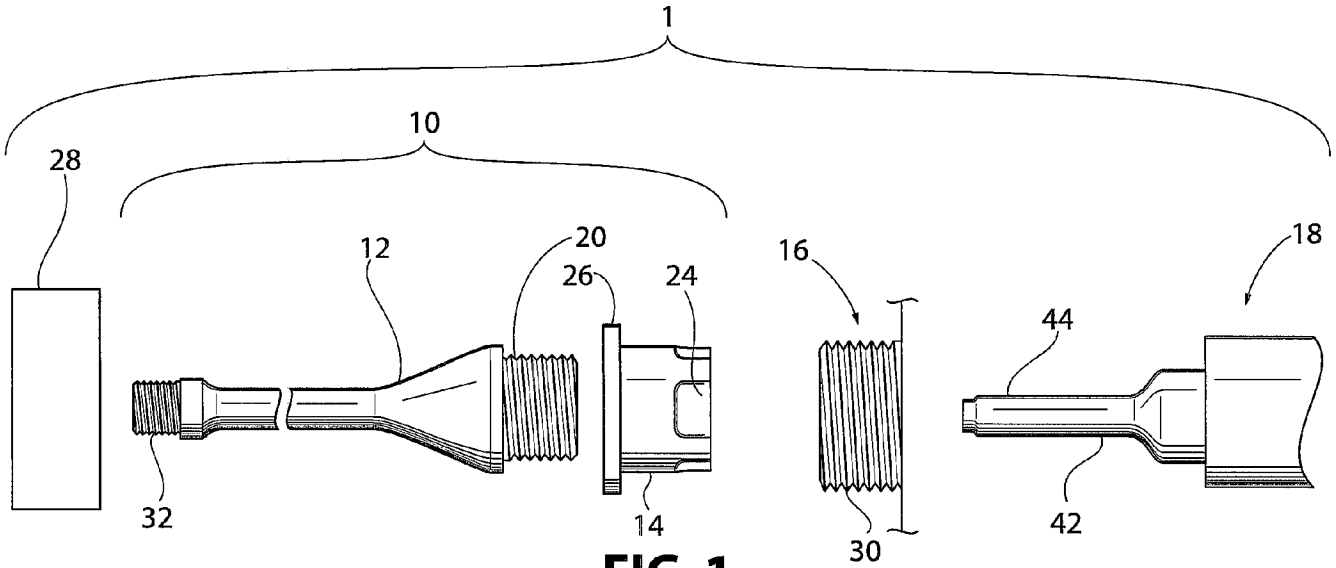
FIG. 1 shows an exploded view of a presently preferred embodiment of the present invention.
Figure 2:
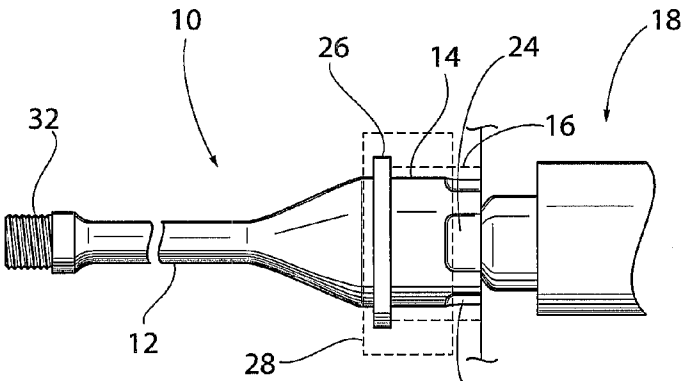
FIG. 2 shows a view of a presently preferred embodiment of the present invention.
Figure 4:
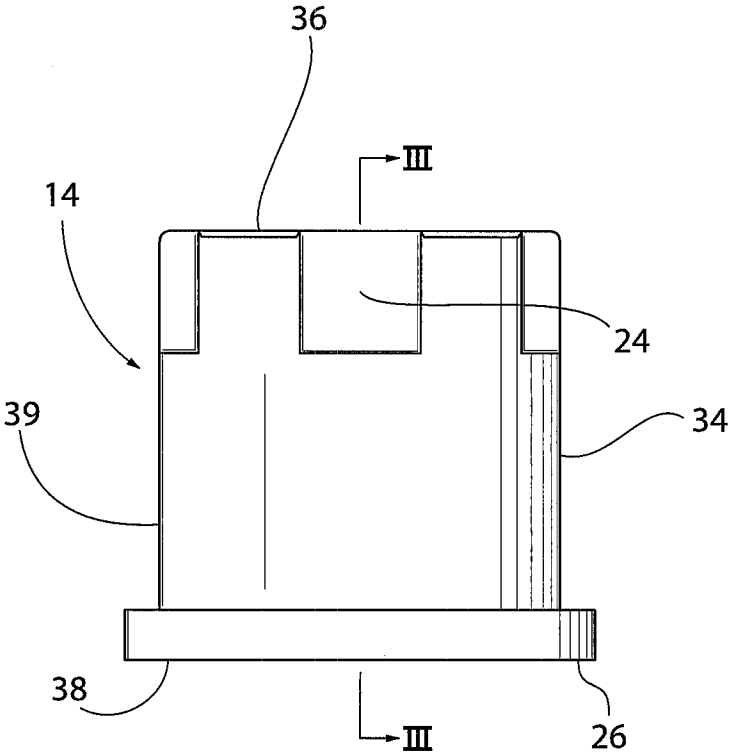
FIG. 4 shows a side elevation view of the barrel extension, shown in FIG. 3, of an embodiment of the present invention.
Figure 3:
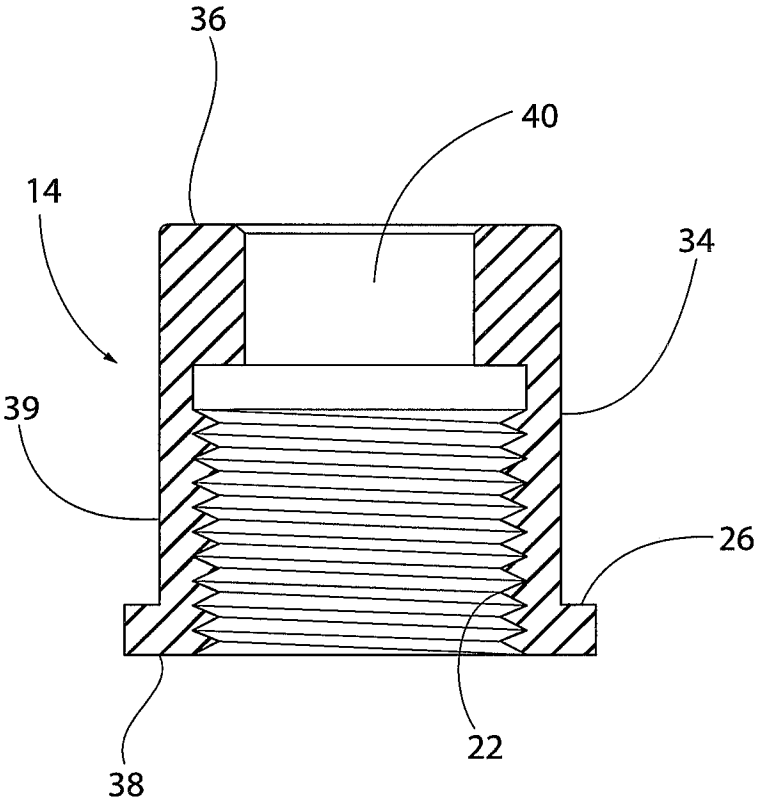
FIG. 3 shows a cross-sectional view taken along lines III-III of a barrel extension, shown in FIG. 4, of an embodiment of the present invention.
Figure 5:
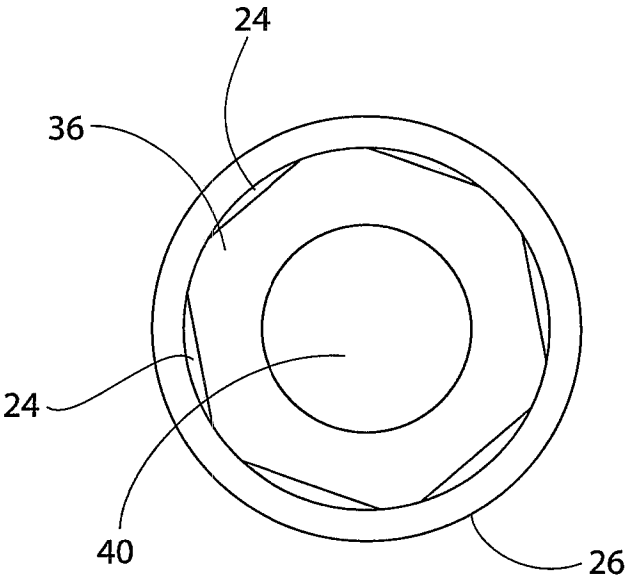
FIG. 5 shows a rear elevation view of the barrel extension shown in FIGS. 3 and 4.
Figure 6:
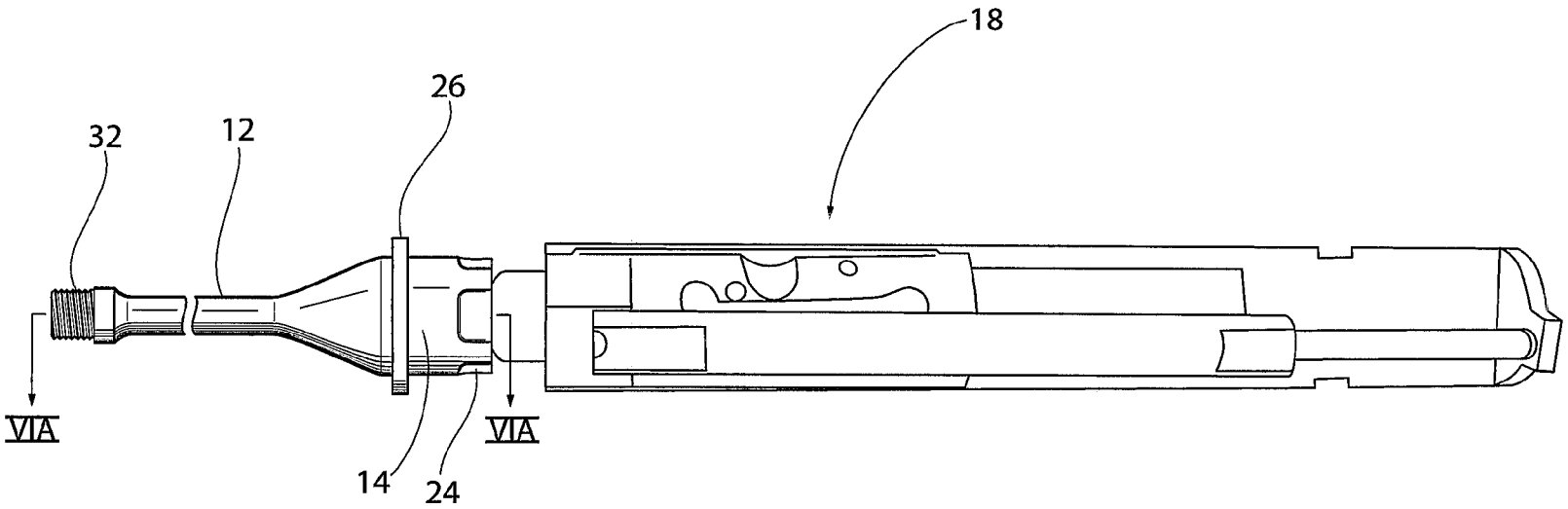
FIG. 6 is a side elevation view of the present invention including the barrel extension, a barrel and a CMMG™ .22LR conversion for an AR15 firearm.
Figure 6A:
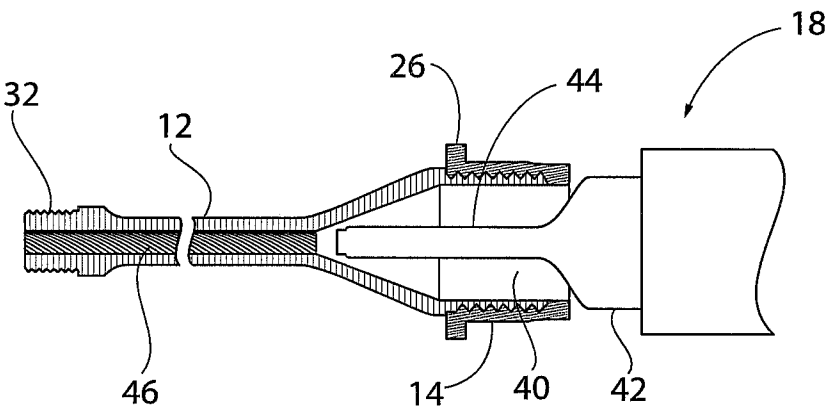
FIG. 6A is a section taken along lines VIA-VIA in FIG. 6.
Figure 7:
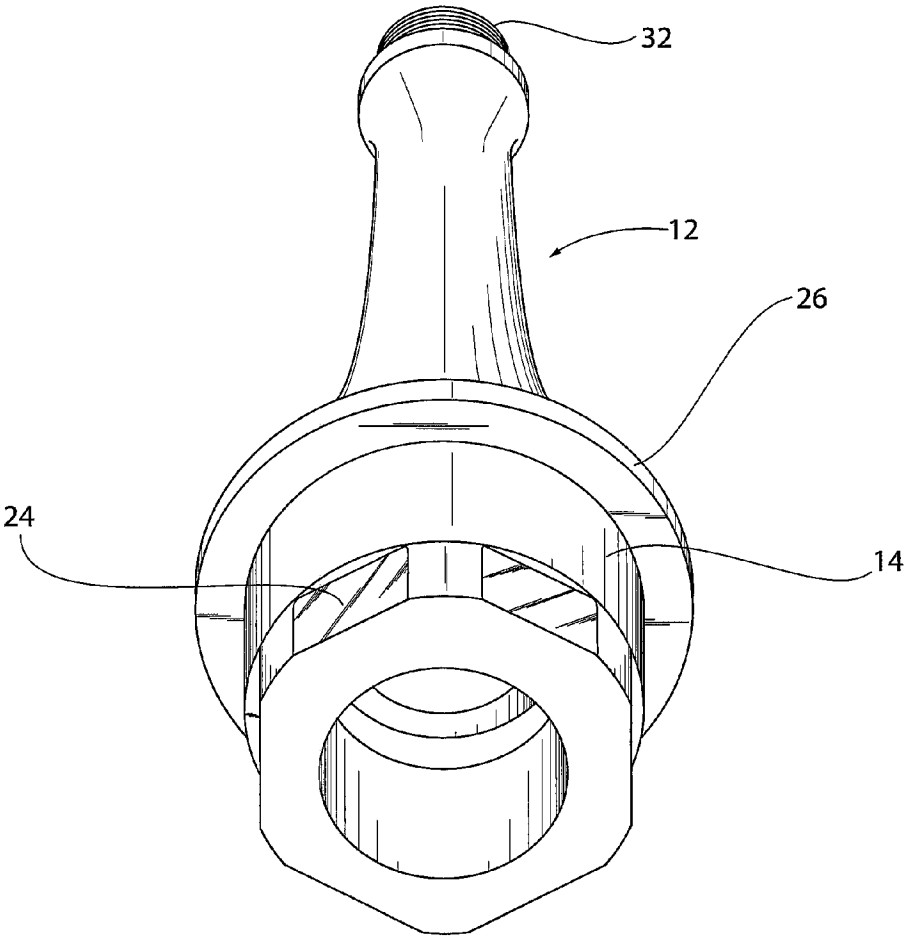
FIG. 7 is an end perspective view of the barrel adapter attached to a rifle barrel.
Figure 8:
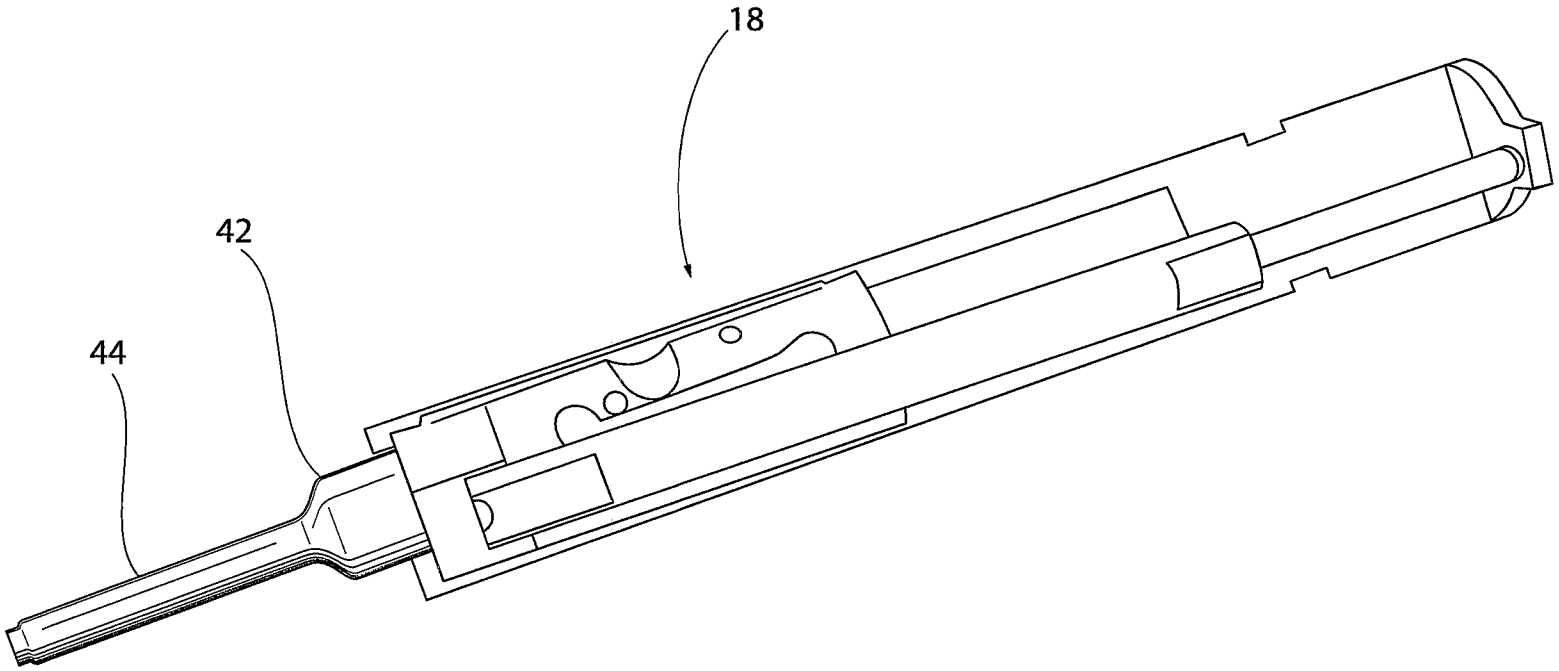
FIG. 8 is a side perspective view of the CMMG™ .22LR conversion.

FIGS. 1 and 2 show an embodiment of the present invention within a rifle assembly generally designated 1. This embodiment of the present invention, generally designated 10, includes a barrel 12, and a barrel extension 14 for attaching a barrel 12 to an upper receiver 16 of a firearm equipped with a .22LR conversion 18. Barrel 12 is threaded into barrel extension 14 by first exterior threads 20 and interior threads 22, as shown in FIG. 3. The barrel extension 14 includes flats 24 configured to aid in installation or removal of the barrel extension 14 to the barrel 12. A wrench or socket (not shown) may be used to contact flats 24 on barrel extension 14 in order to secure barrel extension 14 to barrel 12 via first exterior threads 20 and interior threads 22, as shown in FIG. 3. The barrel extension 14 slides into upper receiver 16 until axial flange 26 contacts the upper receiver 16. A barrel nut 28 is then threaded onto receiver external threads 30 of upper receiver 16 to secure the barrel 12 and barrel extension 14 to the upper receiver 16. Optionally, the barrel 12 includes second external threads 32 which can be used to attach another barrel, flash suppressor or other accessories that can be threaded onto the barrel 12.

Reference is now made more particularly to FIGS. 3-8, which show details of the barrel extension 14. Barrel extension 14 includes a body 34 with first end 36, second end 38, interior threads 22 disposed between first end 36 and second end 38, and a cylindrical sidewall 39 defining a cavity 40 extending from first end 36 and second end 38. The barrel extension cavity 40 is configured to receive exterior profile 42 of .22LR conversion 18 so that an end portion 44 of the .22LR conversion passes into the barrel extension 14.

The bore and rifling 46 of the barrel 12 could be a wide array of dimensions, however, it is particularly desirable that the barrel is configured to shoot .22LR caliber ammunition in order to accurately operate with the .22LR conversion installed in an AR15 firearm. Configured to shoot .22LR ammunition should be understood to mean that the barrel has a bore and a rifling twist rate that is typical in the field for this ammunition. For example, a bore of .222 inches (5.6 mm) and a rifling twist rate of 1 turn in 16 inches (1:16 inches or 1:406 mm) is one typical configuration for .22LR ammunition. The barrel 12 could be formed to have any length.

First end 36 of barrel extension 14 is shaped and configured so that the standard AR15 bolt/bolt carrier assembly (not shown) cannot lock into the barrel extension 14 as originally configured and therefore prevent the firing pin from deploying and striking ammunition in the rifle. For example, the barrel extension 14 could be constructed identically to the standard barrel extension except with the grooves or indentations shaped to accept the lugs/locking lugs of the standard bolt of an AR15 being absent from first end 36 of barrel extension 14. Similarly, one or more grooves or indentations shaped to accept the lugs/locking lugs of the standard bolt of an AR15 could be absent from first end 36 of barrel extension 14. However, other shaping and configurations could be used to prevent the standard bolt from locking with the barrel extension 14 of the current invention. This safety feature aids in preventing a user from firing a larger caliber bullet through a smaller caliber barrel. Thereby preventing damage to the barrel or other parts of the firearm and reducing the risk of injury to person using the firearm.

The barrel extension 14 and barrel 12 may be provided as a kit of parts for installing into a rifle using .22LR conversion 18. The barrel extension 24 and barrel 12 may be provided attached to each other as an assembly to simplify installation.

A method of installing the barrel extension 14 in a firearm, may include the steps of threading a barrel extension 14 onto a barrel 12 via first exterior threads 20 and interior threads 22, as shown in FIG. 3. The Barrel extension 14 is then slid into upper receiver 16 until axial flange 26 contacts the upper receiver 16. A barrel nut 28 is then threaded onto receiver external threads 30 of upper receiver 16 to secure the barrel 12 and barrel extension 14 to the upper receiver 16.

The invention claimed is:

1. A barrel extension device for use with a firearm for use in changing a caliber of ammunition of a firearm from a first caliber ammunition to a second caliber ammunition comprising:

a barrel extension comprising:

a body having a first end and a second end, and a cylindrical sidewall extending between the first end and the second end, said cylindrical sidewall defining a cavity, wherein at least a portion of the cylindrical sidewall is threaded internally and configured for attachment to a barrel, wherein the first end of the body is configured to cooperate with a caliber conversion device to enable firing of a firearm when said caliber conversion device is installed in said firearm so that the firearm can shoot the second caliber ammunition, and wherein the first end of the body is shaped not to cooperate with the bolt in the bolt carrier assembly for the first caliber ammunition to the barrel extension preventing firing of the first caliber ammunition from said firearm when said bolt carrier is installed.

2. The barrel extension device according to claim 1, wherein the first end of the body comprises no indentations required for receiving the bolt of said bolt carrier assembly.

3. The barrel extension device according to claim 1, wherein the cavity is configured to receive an exterior profile of a caliber conversion device.

4. The barrel extension device according to claim 1, wherein the barrel extension comprises flat portions on an exterior surface of the body of the barrel extension.

5. The barrel extension device according to claim 1, wherein the barrel extension and a barrel are secured to each other.

6. The barrel extension device according to claim 1, wherein a barrel configured to shoot .22LR ammunition is secured to the barrel extension.

7. A kit of parts for installing a barrel extension device in a firearm for use in changing a caliber of ammunition of the firearm from a first caliber ammunition to a second caliber ammunition, the kit comprising:

a barrel extension, and a barrel, wherein the barrel extension comprises:

a body with a first end and a second end, and a cylindrical sidewall extending between the first end and the second end, said cylindrical sidewall defining a cavity, wherein at least a portion of the cylindrical sidewall is threaded internally and configured for attachment to a barrel, and wherein the first end of the body is configured to cooperate with a caliber conversion device to enable firing of a firearm when said caliber conversion device is installed in said firearm so that the firearm can shoot the second caliber ammunition, and wherein the first end of the body is shaped not to cooperate with the bolt in the bolt carrier assembly for the first caliber ammunition to the barrel extension preventing firing of the first caliber ammunition from said firearm when said bolt carrier is installed.

8. The kit of parts for installing a barrel extension in a firearm according to claim 7, wherein the first end of the body comprises no indentations required for receiving the bolt of said bolt carrier assembly.

9. The kit of parts for installing a barrel extension in a firearm according to claim 7, wherein the cavity is configured to receive an exterior profile of a caliber conversion device.

10. The kit of parts for installing a barrel extension in a firearm according to claim 7, wherein the barrel extension comprises flat portions on an exterior surface of the body of the barrel extension.

11. The kit of parts for installing a barrel extension in a firearm according to claim 7, wherein the barrel extension and the barrel are secured to each other.

12. The kit of parts for installing a barrel extension in a firearm according to claim 7, wherein the barrel is configured to shoot .22LR ammunition, and is secured to the barrel extension.

13. A method of installing a barrel extension device in a firearm for use in changing a caliber of ammunition of a firearm from a first caliber ammunition to a second caliber ammunition, the method comprising the steps of:

providing a kit of parts for installing a barrel extension in a firearm, the kit comprising:

a barrel extension, and a barrel, wherein the barrel extension comprises: a body with a first end and a second end, and a cylindrical sidewall extending between the first end and the second end, said cylindrical sidewall defining a cavity, wherein at least a portion of the cylindrical sidewall is threaded internally and configured for attachment to a barrel, wherein the first end of the body is configured to cooperate with a caliber conversion device to enable firing of a firearm when said caliber conversion device is installed in said firearm so that the firearm can shoot the second caliber ammunition, and wherein the first end of the body is shaped not to cooperate with the bolt in the bolt carrier assembly for the first caliber ammunition to the barrel extension preventing firing of the first caliber ammunition from said firearm when said bolt carrier is installed, attaching the barrel extension to the barrel, and attaching the barrel extension to the upper receiver of a firearm.

14. The method of installing a barrel extension in a firearm according to claim 13, wherein the first end of the body comprises no indentations required for receiving the bolt of said bolt carrier assembly.

15. The method of installing a barrel extension in a firearm according to claim 13, wherein the cavity is configured to receive an exterior profile of a caliber conversion device.

16. The method of installing a barrel extension in a firearm according to claim 13, wherein the barrel extension comprises flat portions on an exterior surface of the body of the barrel extension.

17. The method of installing a barrel extension in a firearm according to claim 13, wherein the barrel is configured to shoot .22LR ammunition.

* * * * *